US006478688B1

(12) United States Patent
Fukui

(10) Patent No.: US 6,478,688 B1
(45) Date of Patent: Nov. 12, 2002

(54) DEVICE AND METHOD FOR GOLF CLUB FACE ALIGNMENT

(76) Inventor: Masahiro Fukui, 11-2, Nishikomuro 2-chome, Fujiidera, Osaka (JP)

( * ) Notice: Subject to any disclaimer, the term of this patent is extended or adjusted under 35 U.S.C. 154(b) by 0 days.

(21) Appl. No.: 09/454,207

(22) Filed: Dec. 9, 1999

Related U.S. Application Data

(63) Continuation-in-part of application No. 09/119,375, filed on Jul. 20, 1998, now abandoned.

(30) Foreign Application Priority Data

Jul. 25, 1997 (JP) ..... 9-199855

(51) Int. Cl.[7] ..... A63B 53/04
(52) U.S. Cl. ..... 473/251; 473/313; 473/340
(58) Field of Search ..... 473/251–255, 473/313, 340, 341, 268

(56) References Cited

U.S. PATENT DOCUMENTS 3,595,582 A * 7/1971 Chapman
3,698,093 A * 10/1972 Marshall
3,826,495 A * 7/1974 Elkins, Jr.
5,452,897 A * 9/1995 Mick
5,533,728 A * 7/1996 Pehoski

* cited by examiner

*Primary Examiner*—Stephen Blau
(74) *Attorney, Agent, or Firm*—Jordan and Hamburg LLP

(57) ABSTRACT

A facing direction confirming device for a head of a golf club to shoot a golf ball accurately in an intended direction, a method of forming an index of the facing direction of the club head. and a golf club having a club head with the index are disclosed. The confirming device includes a mat, a light source mounted on a first end of the mat for emitting a light beam, a reflecting mirror mounted on an opposite, second end for confining the direction of the light beam, a ball target interposed close to the light source between the light source and the reflecting mirror, and a transparent plate interposed between the light source and the ball target for detecting a light spot reflected from the reflecting mirror. The method of forming an index includes the steps of determining a reference light spot by a reference light on a transparent plate, addressing the head of the golf club on the end facing the reflecting mirror between the light source and the reflecting mirror, calculating a deviation angle to be made between the reference light and a reflected light, and forming an index on the club head for correcting the deviation angle. The golf club includes a club head having an index formed at a position of a crest of the head on the end opposite the face of the head and has an angular difference from the face line formed by the face.

4 Claims, 6 Drawing Sheets

FIG. 10a
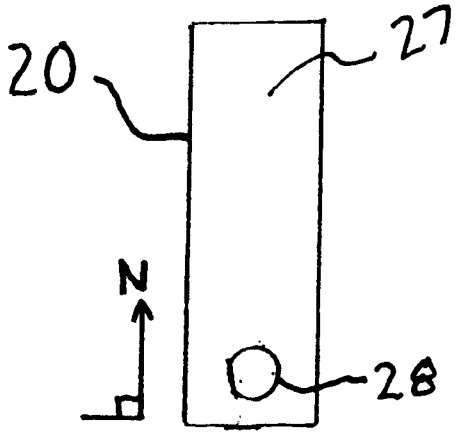
FIG. 10b
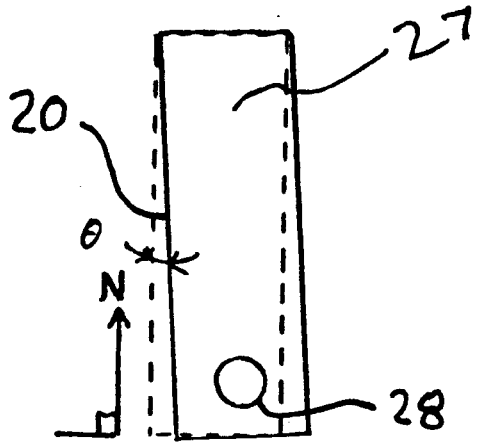
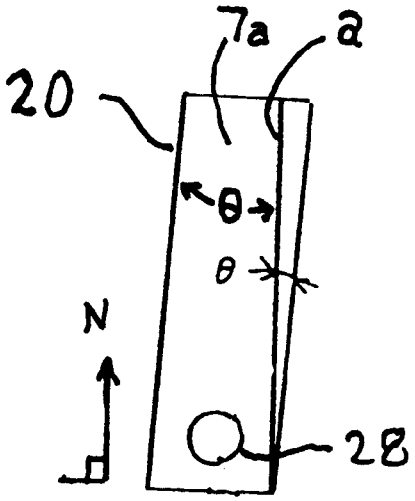
FIG. 10c
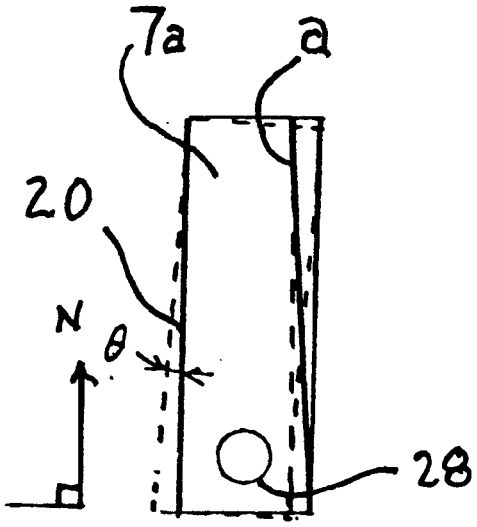
FIG. 10d

DEVICE AND METHOD FOR GOLF CLUB FACE ALIGNMENT

This application is a continuation-in-part application of application Ser. No. 09/119,375, filed Jul. 20, 1998, now abandoned.

BACKGROUND OF THE INVENTION

The present invention relates to: a device for confirming, when a golf club is addressed, whether or not the direction (as will be called the "facing direction") in which the club head is faced is accurately at a right angle with respect to the direction in which a golf ball is to be hit. Also provided is a method of forming such an index on the club head for orienting the facing direction of the club head visually in an accurate direction when the golf club is addressed. Additionally provided is a golf club capable of correcting a deviation of the facing direction, caused by aberations of the trained eye, visually when the golf club is actually addressed. Furthermore provided is a golf club having a head with an index capable of orienting the facing direction visually in an accurate direction.

A putter club, one of the golf clubs, is exemplified in tie prior art by one dedicated especially to an operation to measure whether or not the putter is accurately addressed to have its facing direction to a target cup at a right angle with respect to a straight line, by constructing the device such that a laser beam is emitted from the face of the putter head. However, there exists no device which can perform this measurement operation by using an ordinary golf putter.

In order to practice the accurate addressing of the putter, therefore, there has been employed a putting practicing mat which is provided with a cup and which is provided on its surface with a line directed to the cup and a line intersecting with the former at a right angle. Moreover, this putting practicing mat has been employed to make a correction to orient the facing direction in an accurate direction, such that the putting is practiced by paralleling the line, which is defined by the face of the club head and a corner of a crest, to the perpendicular line on the mat.

Another putter, as employed, is provided on its club head with a parallel index line and/or a perpendicular index line on the face. Whether or not tie putter having such an index line is accurately addressed with respect to the direction in which the golf ball is to be hit is decided with respect to the index line.

Even after a number of practices were made by using the putting practicing mat of the prior art, there is a disadvantage in that no line for confirming the accuracy in the facing direction is indicated on the practice green of a golf course during the actual putting on the course. This makes it necessary for the golfer to determine the facing direction of the putter exclusively by the help of the visual feeling of the player. Hence, the practicing method has failed to achieve an improvement in the putting technique. Here, it is extremely difficult to determine the facing direction of the putter accurately relying just upon the visual feeling of the player himself, and this difficulty cannot be eliminated by the practice or the like in the least. This is because the human being has two eyes, one of which is skillful, or trained, and the other which is not.

At putting, more specifically, the player usually stands at the position of a golf ball to visually determine the direction, in which the ball is to be hit, and then addresses himself to the golf ball. More strictly, the club head of the putter is so arranged that its face line may take a right angle with respect to the trajectory of the hit ball.

Then, the following illusion occurs. When the club head is observed with two eyes, the observer falls in such a feeling that the left eye gazes the club head from the left side thereof whereas the right eye gazes the same from the right side thereof, and that the putter is accurately address at the center of the observer's body and with the face line of the club head being accurately aligned with a line perpendicular to the putting line. As a matter of fact, however, the position of the club head is recognized with the skillful eye and auxiliary with the inferior eye. As a result, the transverse balance cannot be achieved by the observation with the two eyes. By observing the club head with the two eyes at the moment the putter is addressed, the observer feels that the address is correct. As a matter of fact, however, the putter address is deviated to cause a slight deviation between the line perpendicular to the ball hitting direction and the facing direction.

The correctness of this theory is apparent if the putter head is observed only with the inferior eye by closing the superior eye while keeping the position in which the putter is addressed with the two eyes.

Practically, moreover, a deviation is caused between the visions of the right and left eyes by the difference in the visual acuity between the right and left eyes and in the directions of vision.

Even if the player himself believes that he addresses the putter correctly, there is the illusion caused by vision so that the facing direction fails to align accurately with the line perpendicular to the putting direction. The fact is that the facing direction is turned more or less clockwise or counter-clockwise.

For these reasons, moreover, the index line parallel or perpendicular to the face can be utilized, even if indicated, only if the player has an accurate visual feeling, Otherwise, the index line will obstruct the correct putting.

There is also known a putter in which an index line angularly spaced more or less from the face line are indicated on the face line side of a crest the putter so that the deviation in the facing direction can be corrected by adopting the index line as a measure. In this putter, however, the face line and the index line are arranged close to each other, As a result, the two lines overlap and are difficult for the eyes to differentiate making it difficult to address the putter by gazing at only the index line. Moreover, the visual balance may be lost because the two lines are seen. As a result, a contrary effect may be invited by the indicating index line.

SUMMARY OF THE INVENTION

After the keen investigations of the present inventor over many years, it is an object of the invention to provide a device capable of accurately confirming how much a facing direction of a club head is deviated when the head is addressed, a method of forming an accurate index in a club head from angle of deviation, as calculated from the deviation, and a golf club which is able to address the head of a golf club by forming not a mere line but an index utilizing a visual illusion to look straight at only the index while disregarding the face line.

According to the invention, there is provided a facing direction confirming device for a golf club head comprising a mat having a predetermined length, a light source mounted on one end side of the mat for emitting a light beam, a reflecting mirror mounted on the other end side for confirming the direction of the light beam, a ball target interposed close to the light source between the light source and the reflecting mirror, and a transparent plate interposed between the light source and the ball target for detecting a light spot reflected from the reflecting mirror.

With this construction, the beam direction is so adjusted that the beam from the light source is reflected to the light source by the reflecting mirror, the reference light spot by the reference light is determined on the transparent plate and the head of the golf club is addressed on the side of the reflecting mirror between the light source and the reflecting mirror and aimed at the ball target. When the light beam is then emitted from the light source, it is reflected on the face of the club head, and the reflected beam impinges upon the transparent plate so that its reflected light spot can be detected on the transparent plate. If the reflected light spot coincides with the reference light spot, therefore, it can be confirmed that the club head is addressed in the accurate facing direction. If the reflected light spot and the reference light spot fail to coincide, it can be confirmed that the facing direction is inaccurate. It can be further confirmed from the distance between the two light spots how much the facing direction is inaccurate. According to the device for confirming the facing direction of the golf club head, therefore, the golfer is able, merely by addressing the golf club, to confirm instantly whether or not the facing direction of the club head is accurate and to decide easily how inaccurate the facing direction is. Thus, the facing direction confirming device can be employed as a practicing tool for correcting the facing direction of the club head. Since it is possible to measure how inaccurate the facing direction is, moreover, the facing direction continuing device can also be employed as a device for sewing an index to color or deform the club head itself so that the facing direction of the club head may grow accurate, even if the addressing of the golf club is inaccurate.

According to the invention, there is also provided a method of forming an index of the facing direction of the head of a golf club comprising the steps of: determining a reference light spot by a reference light on a transparent plate by mounting a light beam emitting light source on one end side of a mat having a predetermined length, by mounting a reflecting mirror on the other end side for confirming the direction of the light beam, by interposing a ball target close to the light source between the light source ad the reflecting mirror, by interposing a transparent plate between the light source and the ball target for detecting a light spot reflected from the reflecting mirror, and by adjusting the direction of the light beam from the light source so that the light beam may be reflected to the light source by the reflecting mirror; addressing the head of the golf club on the side of the reflecting mirror between the light source and the reflecting mirror such that it may be collated to the ball target; calculating a deviation angle to be made between the reference light and a reflected light, which is reflected on the face of the head of the golf club by emitting the light beam from the light source, by detecting the reflected light spot of the reflected light on the transparent plate, and by metering the distance between the reference light spot and the reflected light spot; and forming an index on the club head for correcting the deviation angle.

By adopting this method, it is possible to form the index which corrects the deviation actually. According to the method of forming the index of the facing direction in the head of the club head, therefore, it is conveniently made possible, by measuring the deviation in the facing direction with the facing direction confirming device, to calculate the line for forming the index, and it is advantageous that the formed index is practical and accurate.

In the method of forming the index of the facing direction of the head of the golf club, it is effective to form the index by changing colors so that the normal face line may be neutralized by making use of the visual illusion.

Moreover, in the method of forming the index of the facing direction of the head of the golf club, it is effective to form the index by changing the shape of the club head so that the normal face line may be neutralized by making use of the visual illusion.

Therefore, the aforementioned methods of forming the index of the facing direction in each putter are one making use of the visual illusion with the colors and the other mating use of the visual illusion with the change in the head shape. According to either method, therefore, the club can be swung without being disturbed by the normal face line of the club head.

According to the invention, still moreover, there is provided a golf club comprising a club head for correcting such a deviation in a facing direction of the face of the club head as might otherwise be caused by the difference of a skillful eye. The most important point of the invention is to invent such golf club.

According to a specific construction, there is provided a golf club comprising a club head having an index formed at a position of the crest of the head on the side opposite to the face of the club head and having a slight difference in the angle from the face line formed by the face. In the golf club, the index is formed by indicating an index line, by changing colors, or by changing the shape of the club head. With this construction, when the club is to be actually swung, this swing can be made accurate by that index without being disturbed by the face line, which is intrinsically formed on the club head. When this golf club employs the facing direction coring device to form the index in the club head by the index forming method, the facing of the club head can be oriented accurately in the direction perpendicular to the ball hitting direction in accordance with the golf technique of each golfer so that this technique can be drastically improved.

BRIEF DESCRIPTION OF THE DRAWINGS

FIG. 10*a* is a schematic diagram showing proper alignment of a normal putter;

FIG. 10*b* is a schematic diagram showing improper alignment of a normal putter and of the putter of the present invention;

FIG. 10*c* is a schematic diagram showing alignment of the putter of the present invention; and FIG. 10*d* is a schematic diagram showing proper alignment of the putter of the present invention.

DESCRIPTION OF THE PREFERRED EMBODIMENTS

The invention will be described in detail in connection with its embodiments with reference to the accompanying drawings. The invention will be based on a putter, but could likewise be applied to the remaining golf clubs.

Figure 1:
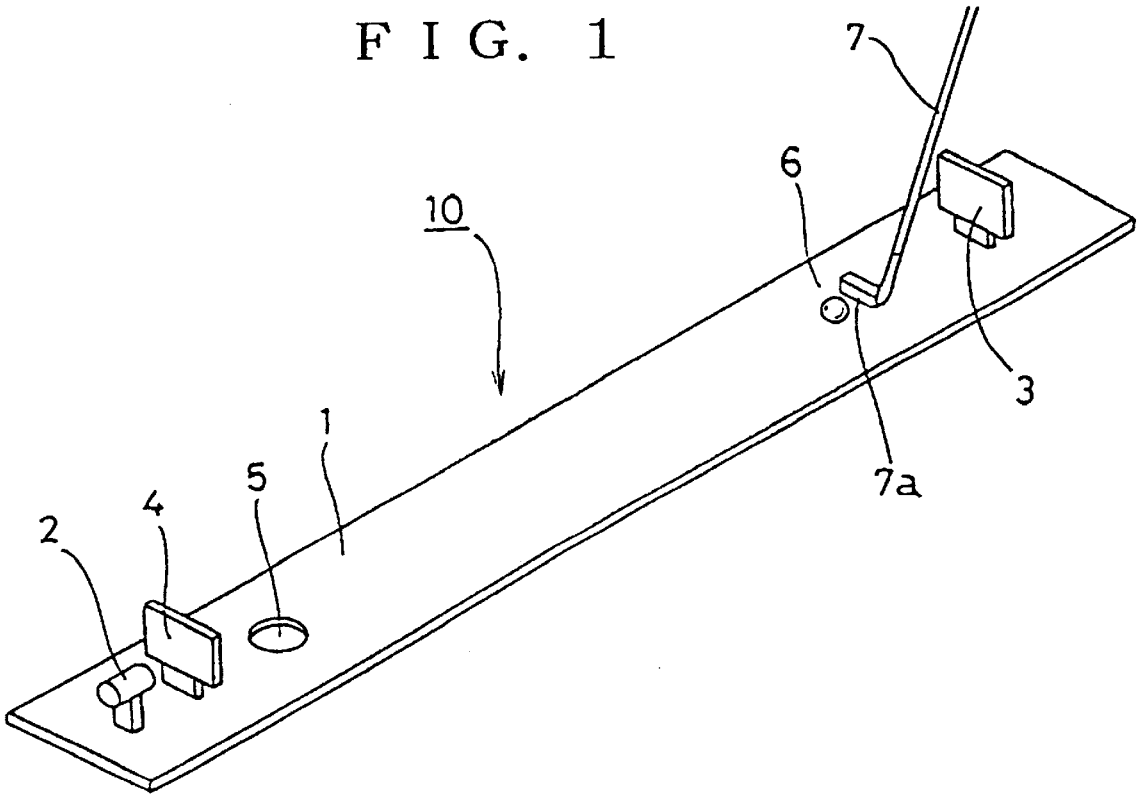
FIG. 1 is an environmental perspective view showing a putter facing direction confirming device according to the invention.
Figure 2:
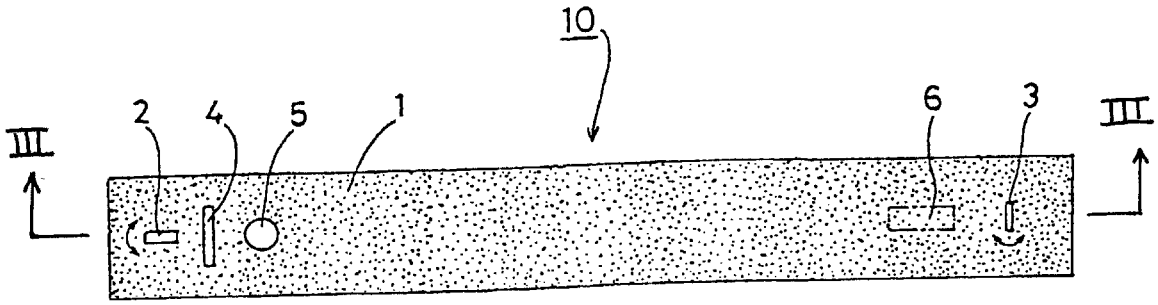
FIG. 2 is a top plan view showing a facing direction confirming device.
Figure 3:
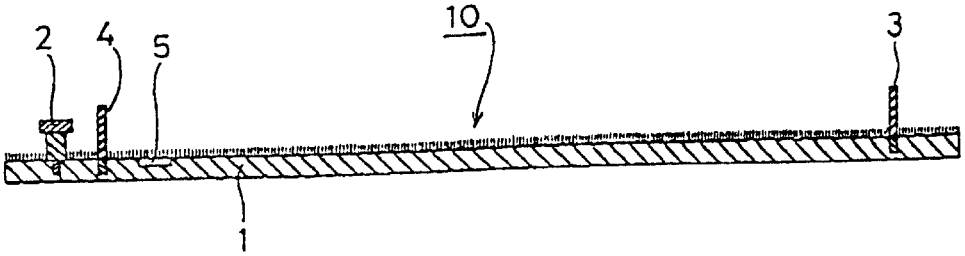
FIG. 3 is a cross-sectional view showing the facing direction confirming device taken along line III—III.
Figure 4:
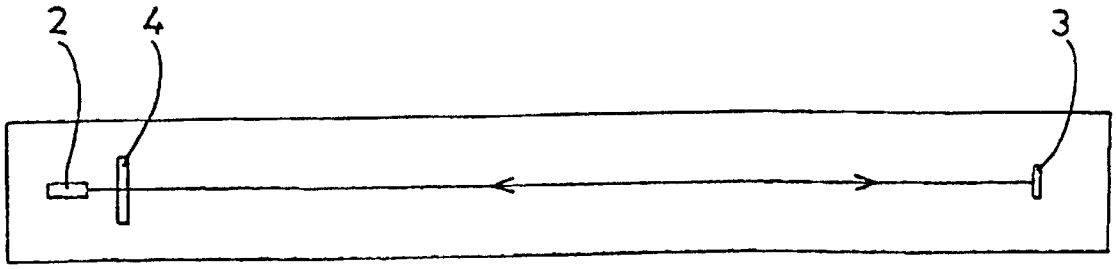
FIG. 4 is a schematic diagram showing the trajectory of a light at a time that the facing direction confirming device is not in use.

In FIGS. 1 to 3, reference numeral 10 designates a facing direction confirming device for a putter. This facing direction confirming, device 10 is equipped with a light source 2, which is mounted at one end side on a mat 1 having a predetermined length for emitting a beam of light. This light source is properly exemplified by one for emitting a straight beam such as a laser beam. At the other end side of the mat 1, there is mounted a reflecting mirror 3 for confirming whether or not the light beam emitted from the light source 2 is accurately oriented. As shown in FIG. 4, the beam emitting direction of the light source 2 is so adjusted that the light beam emitted from the light source 2 may be reflected to the light source 2 by the reflecting mirror 3. Between the light source 2 and the reflecting mirror 3, there is interposed a transparent plate 4, which is arranged closer to the light source 2 for sensing and detecting the reflected beam. The transparent plate 4 is coated to transmit the light beam incident on the side of the light source 2 but to reflect the light beam incident on the side of the reflecting mirror 3. Accordingly, the transparent plate 4 may be coated or etched so as to reflect or diffuse light reflected from the reflecting mirror 3 and thus present a visible spot. Furthermore, the transparent plate 4 may be etched or coated such that and area where the light from the light source 2 passes through the transparent plate 4 is left clear while remaining portions diffuse or reflect light. Thus, when the light beam is reflected back deviating from the path of the incident beam it strikes an area other than the area left clear and produces a visible spot. In the mat 1, there is formed in front of the transparent plate 4 a ball target 5, which is formed as a hole corresponding to a cup or the target of the golf game. The mat 1 is made preferably of an artificial turf mat for providing the feeling of the putting green of a golf course. The facing direction confirming device 10 thus far described according to the invention is used by the following procedure. Specifically, the light beam, as emitted from the light source 2 to the reflecting mirror 3, and reflected to the light source 2 by the reflecting mirror 3 so that it is detected on the transparent plate 4, is employed as a reference beam, and the point of detection on the transparent plate 4 is employed as a reference light spot. As shown in FIG. 1, moreover, the head 7*a* of the putter 7 is placed at a position 6, which is located on the end of the reflecting mirror 3 between the light source 2 and the reflecting mirror 3, and is addressed and collimated to the ball target 5. When the light beam is then emitted from the light source 2, the light beam reflects on the facing side 11 of the putter head 7*a* and its reflected beam reaches the transparent plate 4. Then, the reflected spot can be detected on the transparent plate 4. If the reflected light spot is aligned with the reference light spot, it is confirmed that the putter 7 is addressed in the accurate facing direction. If the reflected light spot and the reference light spot are misaligned, it is confirmed that the facing direction is inaccurate. It is then deter from the distance between the reflected light spot and the reference light spot how much the facing direction is inaccurate.

As a result of the way the facing direction coming device 10 is constructed, as described above, the golfer is able, merely by addressing the putter, to instantly confirm whether or not the putter facing direction is accurate and to easily decide how much the facing direction is inaccurate. Thus, the facing direction confirming device 10 can be employed as a practice tool for correcting the putter facing direction fly the following method, on the other hand, the facing direction confirming device 10 can also be used as a measuring device for manufacturing a putter which can be oriented in the accurate facing direction even if inaccurately addressed.

Figure 5:
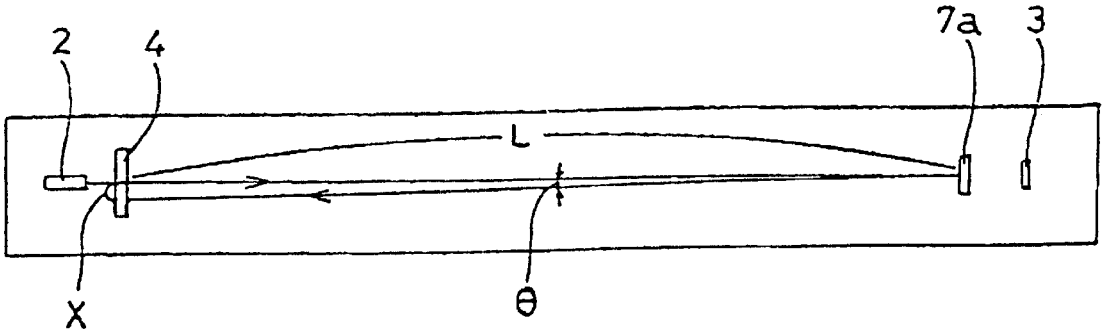
FIG. 5 is a schematic diagram showing the trajectory of a light at a time that of the facing direction confirming device is in use.
Figure 6:
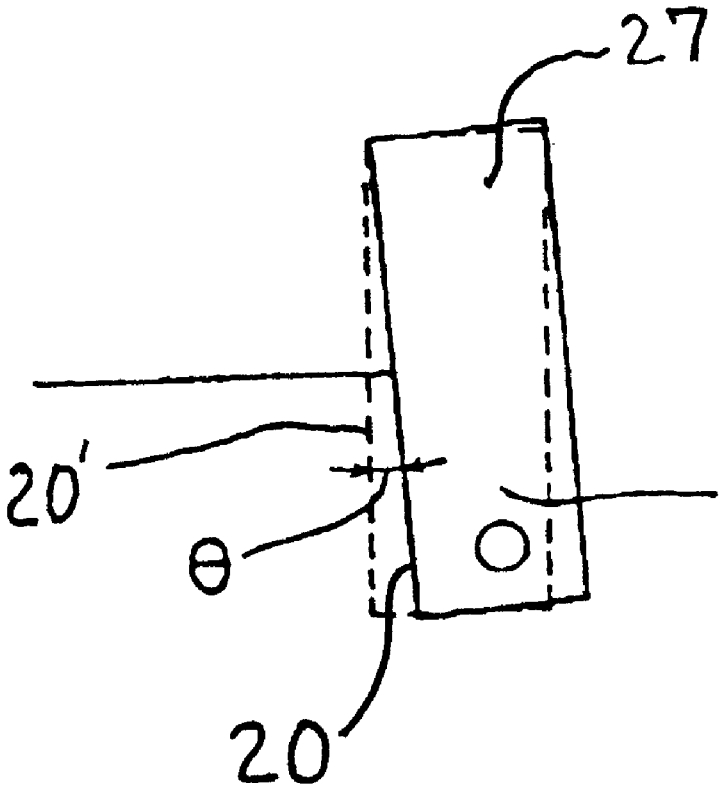
FIG. 6 is a schematic diagram showing a deviation when the putter is actually made ready.

FIG. 5 schematically shows the state in which the reflected light spot and the reference light spot are misaligned. If the distance from the reflected light spot to the reference light spot is measured and designated at X and if the distance from the position of the putter head to the transparent plate is measured and designated at L, an angle of deviation θ, as made between the reference light and the reflected light, can be calculated by Formula: $\tan \theta = X/L$. Referring to FIG. 6, this calculated deviation angle θ is one which is made between a virtual face line 20' of a conventional putter 27 perpendicular to the reference light, shown dashed and considered herein as normal, and the face line 20 when the putter is addressed, as shown in FIG. 6.

Figure 7:
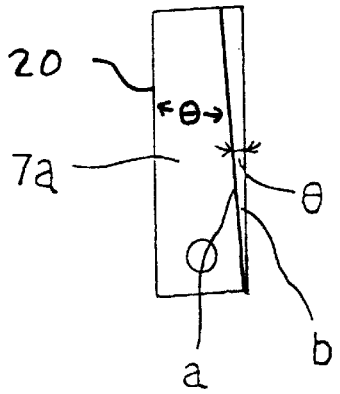
FIG. 7 is a schematic diagram showing a state in which the putter is to be indexed in the facing direction.
Figure 8:
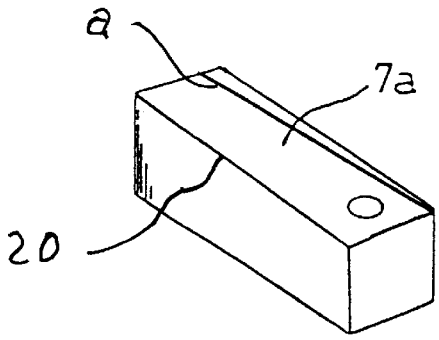
FIG. 8 is a perspective view showing a portion of the putter head for which the facing direction index is indicated in the putter by an index line.

Referring to FIGS. 7 and 8, the putter head 7*a* of the present invention is provided wit an index line a which is inclined with respect to the face line 20 and the back face by the angle θ, presuming of course the front and back faces are parallel. It is understood that the index line a is to be inclined by the angle θ relative to the face line 20 in the event the front and back aces are not parallel since alignment of the face line 20 is the object of concern. Once the index line a is set, the golfer then addresses the index line a relative to the ball and perceived line of travel instead of the face line 20. In doing so, the golfer will naturally correct the error angle θ presuming he aligns the index line a as he would normally align the face line 20.

Referring to FIGS. 10*a*–10*b*, the functioning of the putt head 7*a* is further explained with reference to the conventional putter 27. The normal direction line N indicates the normal which the face line 20 should be aligned parallel with when the putter is properly addressed. In FIG. 10*a* the conventional putter 27 is shown with the face line property addressed, that is, aligned parallel to the normal line N. In FIG. 10*b*, the conventional putter 27 is shown improperly addressed, or aligned, wherein the golfer's natural error angle θ, that is, the angle error that exists when the golfer believes the face line 20 is properly aligned, is the deviation between the face line 20 and the normal line N.

Referring to FIG. 10*c*, the putter head 7*a* of the present invention has the index line a provided thereon inclined by the error angle θ with respect to the face line 20. In the embodiment shown the index line is provided on the far side of the hossel 28 from the face line 20 and extending to a corner of the putter head 7*a*. This position displaces the index line a from the face line 20 thereby reducing the possibility of visual confusion. However, the placement of the index line a may be varied provided that the error angle θ is maintained between the index line a and the face line 20.

Referring to FIG. 10*d*, the putter head 7*a* is shown properly aligned. The golfer concentrates on aligning the index line a instead of the fat line 20 and in doing so improperly aligns the index line a non-parallel to the normal line N. Since the golfer naturally perceives the index line a as parallel to the normal line when it is not, he unknowingly incorporates the error angle θ in his positioning of the putter head 7*a*. However, since the index line a is inclined by the error angle θ relative to the face line 20, the face line 20 is properly aligned parallel to the normal line N.

Next, a deviation angle region b, as located on the right side of the index line a in FIGS. 7 and 8, is colored with a tint close to that of the turf, and the region on the left side of the index line a is colored with a tint seen markedly to the eyes of the golfer, for example. Thus, the putter is addressed with reference to the index line aided by optical illusion provided by the colors. As a result, the address is made with the putter face being at a right angle with respect to the reference light, i.e., the putting direction so that the golf ball can be accurately putted in the intended direction. The deviation angle region b is colored in a neutral tint to cause an optical illusion of the region b vanishing. Thus, the index line a is formed with a change in colors.

Figure 9:
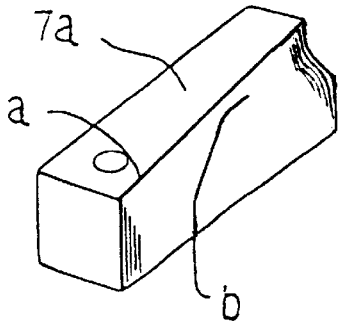
FIG. 9 is a perspective view showing a portion of the putter head for which the facing direction index is indicated with change in the head shape of the putter.

The illusion should not be limited to that of colors, as described above, but can be effected by a change in shape, as shown in FIG. 9. Specifically, the putter head is cut away partially but clearly along the index line a, and this cut face and the remaining head face are continued by the smooth curved surface, by which the intrinsic face line is made neutral. Thus, the cutting line on the crest of the putter head is confused as if it were the face line.

The putter thus having the index formed by the aforementioned method actually enables the golfer to perform an accurate patting with reference to the index without minding the intrinsic face line of the putter head. At the pitch of 0.5 degrees and within a range of 0.5 to about 3 degrees, on the other hand, there are prepared putter heads (as shown in FIGS. 7 and 8) having the index line a, the putter heads having the colored deviation angle region b, or the putter heads (as shown in FIG. 9) having the index line a distinguished by the change in shape. With these preparations, the putter clubs can be instantly exploited in response to the request of a consumer and can be massively manufactured to lower the manufacture cost.

The putter club thus having the club head with the index is an example of a club having a club head capable of correcting such a deviation in the facing direction as might otherwise be caused by the difference of a skillful eye.

What is claimed is:

1. A putter for putting a golf ball, comprising:

a shaft;

a club head having a said shaft mounted therein, a front face for striking the golf ball which defines a face line, said club head having a top surface extending from a top edge of said front face to a straight index edge along a substantial length of a head, which is inclined at an angle relative said face line for compensating for alignment error when used as an illusory face line; and said club head having a back face, opposite said front face, smoothly curving downward or upward from said index edge to a surface portion thereof which is substantially parallel to said front face.

2. The putter of claim 1 wherein said top surface has a surface color which is different from a back face color of said back face.

3. The putter of claim 2 wherein said index edge is positioned on a side of said shaft opposite that of said front face.

4. The putter of claim 1 wherein said index edge is positioned on a side of said shaft opposite that of said front face.

* * * * *